US006092667A

United States Patent [19]

Steinmuller et al.

[11] Patent Number: 6,092,667

[45] Date of Patent: Jul. 25, 2000

[54] METHOD AND APPARATUS FOR AERATION OF LIQUIDS OR SLURRIES

[75] Inventors: Arno Steinmuller; Michael Hugh Moys; Andre Nardus Terblanche, all of Gauteng Province, South Africa

[73] Assignee: Multotec Process Equipment Limited, South Africa

[21] Appl. No.: 09/208,551

[22] Filed: Dec. 9, 1998

[30] Foreign Application Priority Data

Dec. 9, 1997 [ZA] South Africa ..... 97/11028

[51] Int. Cl.[7] ..... B03D 1/14; B03D 1/24; B01F 3/04

[52] U.S. Cl. ..... 209/164; 209/170; 210/220; 210/221.2; 261/76; 261/123; 261/DIG. 75

[58] Field of Search ..... 209/164, 170; 261/76, 123, DIG. 75; 210/220, 221.02

[56] References Cited

U.S. PATENT DOCUMENTS

| | | |
|---|---|---|
| 1,311,920 | 8/1919 | Seale et al. . |
| 1,380,665 | 6/1921 | Lyster . |
| 4,110,210 | 8/1978 | Degner . |
| 4,162,971 | 7/1979 | Zlokarnik . |
| 4,477,341 | 10/1984 | Schweiss . |
| 4,534,862 | 8/1985 | Zlokarnik . |
| 4,938,865 | 7/1990 | Jameson . |
| 5,332,100 | 7/1994 | Jameson . |
| 5,505,881 | 4/1996 | Eades . |

FOREIGN PATENT DOCUMENTS

| | | |
|---|---|---|
| 1724589 | 4/1992 | U.S.S.R. . |
| 92/03218 | 3/1992 | WIPO . |
| 92/03219 | 3/1992 | WIPO . |
| 92/03220 | 3/1992 | WIPO . |
| 97/41962 | 11/1997 | WIPO . |

*Primary Examiner*—Thomas M. Lithgow
*Attorney, Agent, or Firm*—Ostrolenk, Faber, Gerb & Soffen, LLP

[57] ABSTRACT

A method of aerating a liquid comprising the steps of providing a column, introducing liquid under pressure into an upper zone of the column in the form of a jet of liquid directed in a path, permitting gas to be entrained by the jet of liquid, obstructing the path of the jet of liquid to form a zone of turbulence in which bubbles are formed in the liquid to create a foam or froth bed in the column, and removing the foam or froth.

11 Claims, 4 Drawing Sheets

METHOD AND APPARATUS FOR AERATION OF LIQUIDS OR SLURRIES

FIELD OF THE INVENTION

This invention relates to a method and apparatus for aeration of liquids and slurries and more particularly, but not exclusively, to a flotation method and apparatus for beneficiation of mineral pulps and slurriers.

BACKGROUND TO THE INVENTION

In mineral processing, flotation is a process used to recover fine particulate solids contained in mineral pulps or slurries. The particles which are to be removed are treated with suitable reagents to render them water repellent and air or a suitable gas is introduced into the pulp or slurry to form small bubbles. The water repellent particles which come into contact with the bubbles adhere to the bubbles and rise to the surface of the pulp or slurry to form a foam or froth. The foam or froth with adherent particles is removed and the particles are recovered therefrom.

This type of process can be used in applications other than mineral processing, for example in the aeration of water or other liquid in waste water treatment and pollution control, in the separation of oil from water and in the separation of fibrous material from effluent streams.

In this specification, the term "liquid" is taken to include a mineral pulp or slurry.

A flotation process of this nature is to a large extent dependent on a sufficient rate of production of gas bubbles, and on the size distribution of the gas bubbles, which determines the key parameter of the rate of production of bubble surface area.

Amongst a variety of devices suitable for this purpose, it is known to provide a downpipe comprising a substantially vertically extending conduit having an open lower end, liquid supply means arranged to supply liquid under pressure to at least one downwardly facing nozzle located within the upper part of the conduit so as to form a downwardly issuing jet of liquid from the nozzle within the conduit. Air is entrained from the atmosphere and is partly sheared into relatively fine bubbles, and partly simply mixed into the dispersion to form bigger bubbles, and bubble slugs. The conduit may be submerged in a separating vessel containing liquid, wherein the dispersion of the fine bubbles issues from the base of the conduit and rises upwardly to form a froth-liquid interface and a froth layer.

The design of such aerators has some disadvantages. Gas which is entrained as big bubbles or as bubble slugs does not contribute to a sufficiently high extent to the aeration process, because big bubbles contribute less surface to the process than smaller bubbles of the same total gas volume. Another disadvantage of entraining air in the form of big bubbles is that big gas bubbles or slugs will rise upwardly in the conduit as soon as they have left the region of high downwards velocity created by the jet. This gas might be re-entrained by the jet but it is more advantageous to create finer bubbles in the first place rather than having the gas entrained as big bubbles, have it rising upwards and then being re-entrained. The immediate production of fine bubbles will increase the overall gas entrainment rate and gas carrying capacity of the system, and will also increase the bubble surface production rate. Hence the performance of such a prior art device may be limited by the air entrainment pattern of the liquid jet which may produce a significant amount of large bubbles unsuitable for the desired operation.

It is known that a certain amount of turbulence is beneficial to the flotation process as it promotes the contacting of bubbles and particles. However, too much turbulence can pose a problem to the process, as existing bubble-particle clusters may be destroyed. A prior art aerator as described above will have a turbulent environment throughout the major part of the downcomer, dependent on the velocity and diameter of the jet.

It is also known that in a co-current downpipe of the abovementioned kind, the velocity pattern created by the jet, especially in the case of having one single, large-diameter jet in large-diameter downpipes, is such that a high-velocity stream from the jet develops in the downpipe. This may lead to unfavourable residence time distributions, creation of "dead" zones in the downpipe and suboptimal use of the reactor volume.

OBJECT OF THE INVENTION

It is accordingly an object of the invention to provide a method and apparatus for aeration with which disadvantages of the abovementioned kind are sought to be lessened or at least to provide a useful alternative to existing systems.

SUMMARY OF THE INVENTION

According to the invention a method of aerating a liquid comprises the steps of providing a column, introducing liquid under pressure into an upper zone of the column in the form of a jet of liquid directed in a path, permitting gas to be entrained by the jet of liquid, obstructing the path of the jet of liquid to form a zone of turbulence in which bubbles are formed in the liquid to create a foam or froth bed in the column, and removing the foam or froth.

Preferably the column is located in a vessel containing liquid and the foam or froth is allowed to issue from an open lower end of the column and to rise upwardly in the vessel to form a foam or froth liquid interface and a foam or froth layer above the interface.

The zone of turbulence is preferably formed in the column by directing the jet of liquid into a receptacle located within the column in an upper zone thereof and allowing the foam or froth formed in the receptacle to overflow into the column. In this way the energy embodied in the jet of liquid is concentrated in a confined space to optimize the production of fine bubbles in the liquid.

The gas may be entrained through an opening in the column.

The amount of foam or froth formed in the receptacle may be varied by adjusting the height of the receptacle within the column.

The invention also envisages apparatus for aerating a liquid comprising a column, a nozzle provided in an upper zone of the column to permit a jet of liquid to be directed in a path into such zone, gas inlet means permitting entrainment of gas by the jet of liquid, and obstruction means for obstructing the path of the jet of liquid to create a zone of turbulence within the column and thereby to form a foam or froth bed within the column.

The obstruction means preferably comprise a receptacle mounted co-axially in the upper zone of the column.

The column may be mounted in a vessel containing liquid and may have an open lower end so that foam or froth formed in the receptacle issues from the lower end of the column and rises upwardly in the vessel to form a foam or froth interface and a foam or froth layer above the interface.

The receptacle may be suspended on elongate members depending from a cover closing the upper end of the column, the elongate members being extensible and retractable relative to the cover to adjust the height of the receptacle in the column. The elongate members may be open-ended tubular members providing the gas inlet means permitting entrainment of gas by the jet of liquid.

DESCRIPTION OF THE DRAWINGS

Preferred embodiments of the invention will now be described by way of example with reference to the accompanying drawing in which.

DETAILED DESCRIPTION OF THE INVENTION

Figure 1:
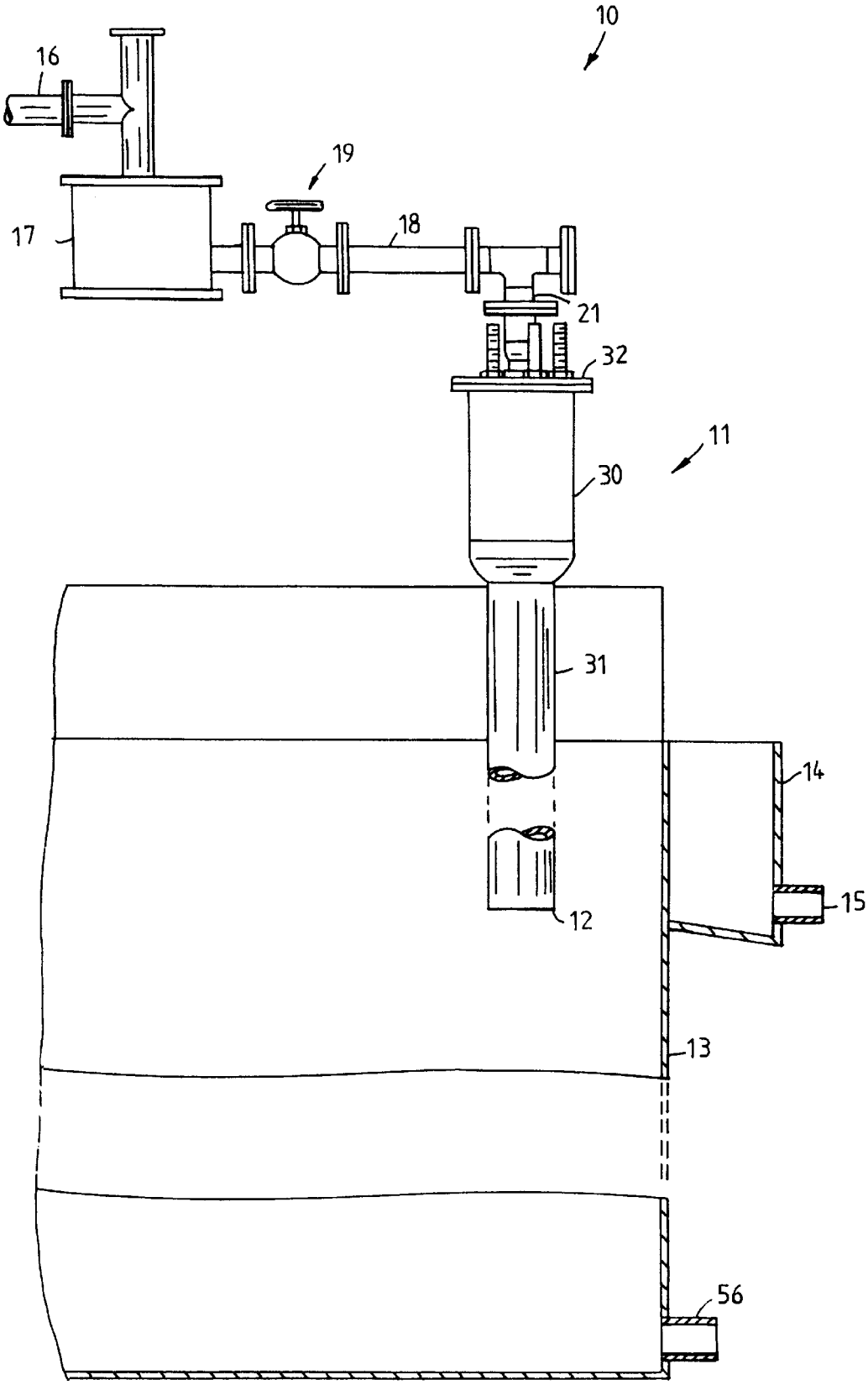
FIG. 1 is a schematic cross-sectional elevation of a flotation apparatus constructed in accordance with the invention.

A flotation apparatus 10 constructed in accordance with the invention comprises an upright flotation column in the form of a tubular downpipe 11 having a lower open end 12 located in a separating vessel 13. The separating vessel 13 is surrounded by a launder 14 having an outlet 15 and is filled with liquid so that is this embodiment of the invention, the open end 12 of the downcomer 11 is located below the level of the liquid in the separating vessel.

In practice, the downpipe 11 will be one of a plurality of downpipes arranged to project into the separating vessel 13. The diameter of each downpipe where it projects into the liquid in the separating vessel 13 may range from 50 mm to 400 mm, depending on the size of the separating vessel, delivering between 2 $m^3/h$ to 160 $m^3/h$ of slurry to the separating vessel. Typically the separating vessel 3 may be about 7 m in height and the downcomer 11 about 3 m in height.

In the apparatus 10, a mineral slurry supply pipe 16 feeds slurry to a distribution box 17, from where the slurry is fed via a distribution pipe 18 with a valve 19 in it, to a T-piece 20 which connects to a nozzle pipe 21, itself connecting by means of a flange 22 to the downpipe 11.

Figure 3:
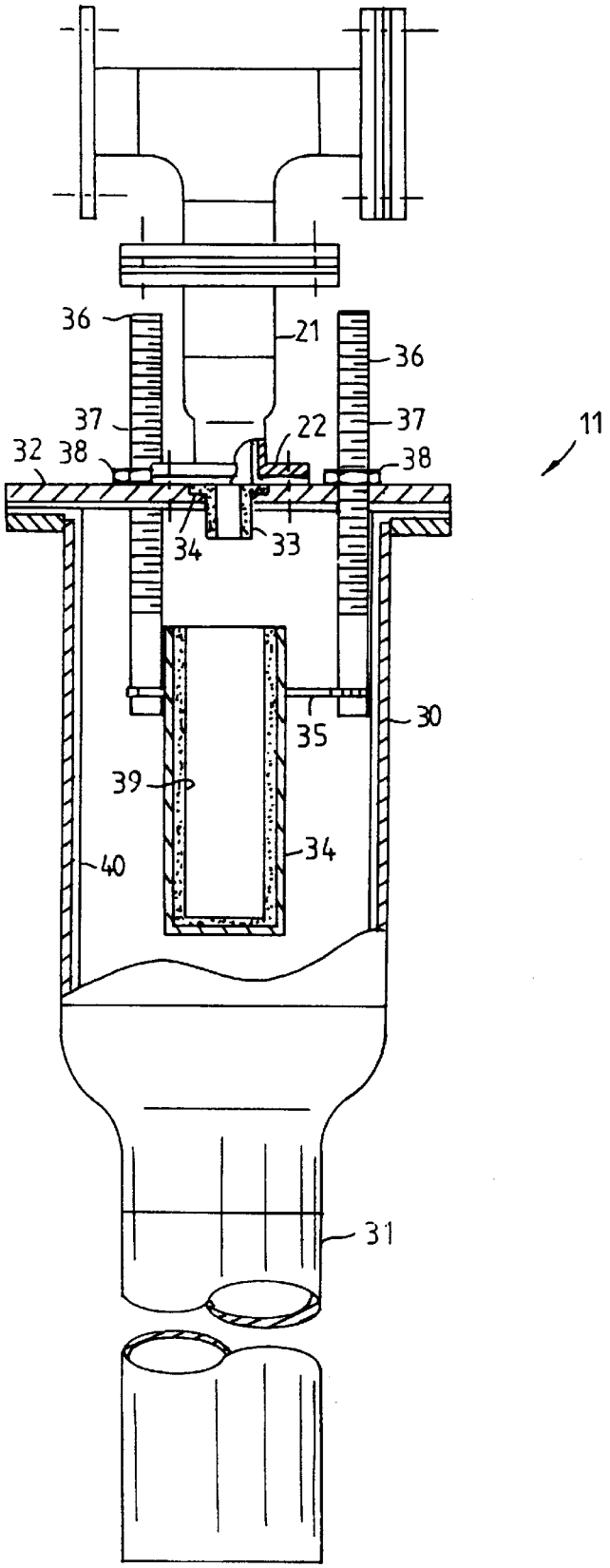
FIG. 3 is a cross-sectional elevation of the flotation column of FIG. 2.

The downpipe 11 comprises a tubular head 30 which merges with a tubular stem 31. The head 30 is closed by a cover plate 32 bolted to the head and at the centre of which is mounted a ceramic nozzle 33 which communicates with the nozzle pipe 21. Conveniently, the nozzle 33 may fit into a recess 34 formed in the cover plate 32 (FIG. 3).

Below the nozzle 33, a receptacle 34 is mounted co-axially in the head 30, that is to say in an upper zone of the downpipe 11. In this embodiment of the invention the receptacle 34 is mounted on radial stays 35 which are connected to hangers in the form of tubular rods 36 projecting through the cover plate 32. The tubular rods 36 are open at their ends and form air inlets to the interior of the head 30. The tubular rods 36 are threaded in their central regions as indicated by numeral 37 and are held in place by complementarily threaded nuts 38 seating on the cover plate 32. Rotation of the nuts 38 results in displacement of the receptacle 34, thereby allowing the height of the receptacle in the head 30 to be adjusted. The receptacle 34 is lined with a liner 39 to protect it against wear. The interior of the head is also preferably lined with a lining 40, such lining not being shown in FIG. 4.

Figure 4:
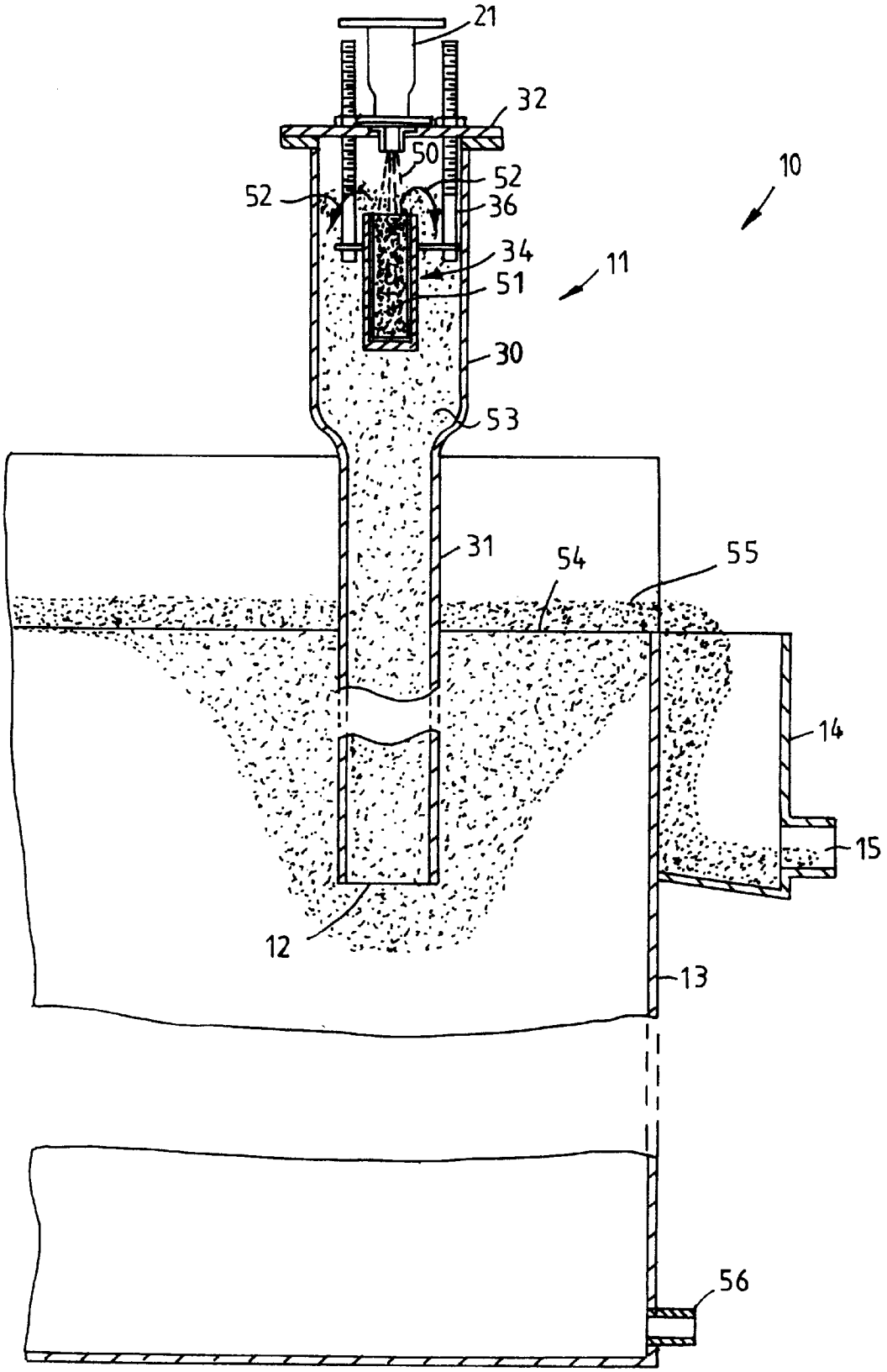
FIG. 4 illustrates the use of the flotation column of FIGS. 2 and 3.

In use, slurry is supplied under pressure to the distribution box 17 and issues under pressure through the distribution pipe 18 and nozzle pipe 21 to the nozzle 33, causing a jet 50 to issue in a downward path into the receptacle 34 (FIG. 4). The jet 50 of slurry issuing from the nozzle 33 freely entrains air through the open ended tubular hangers 36.

Figure 2:
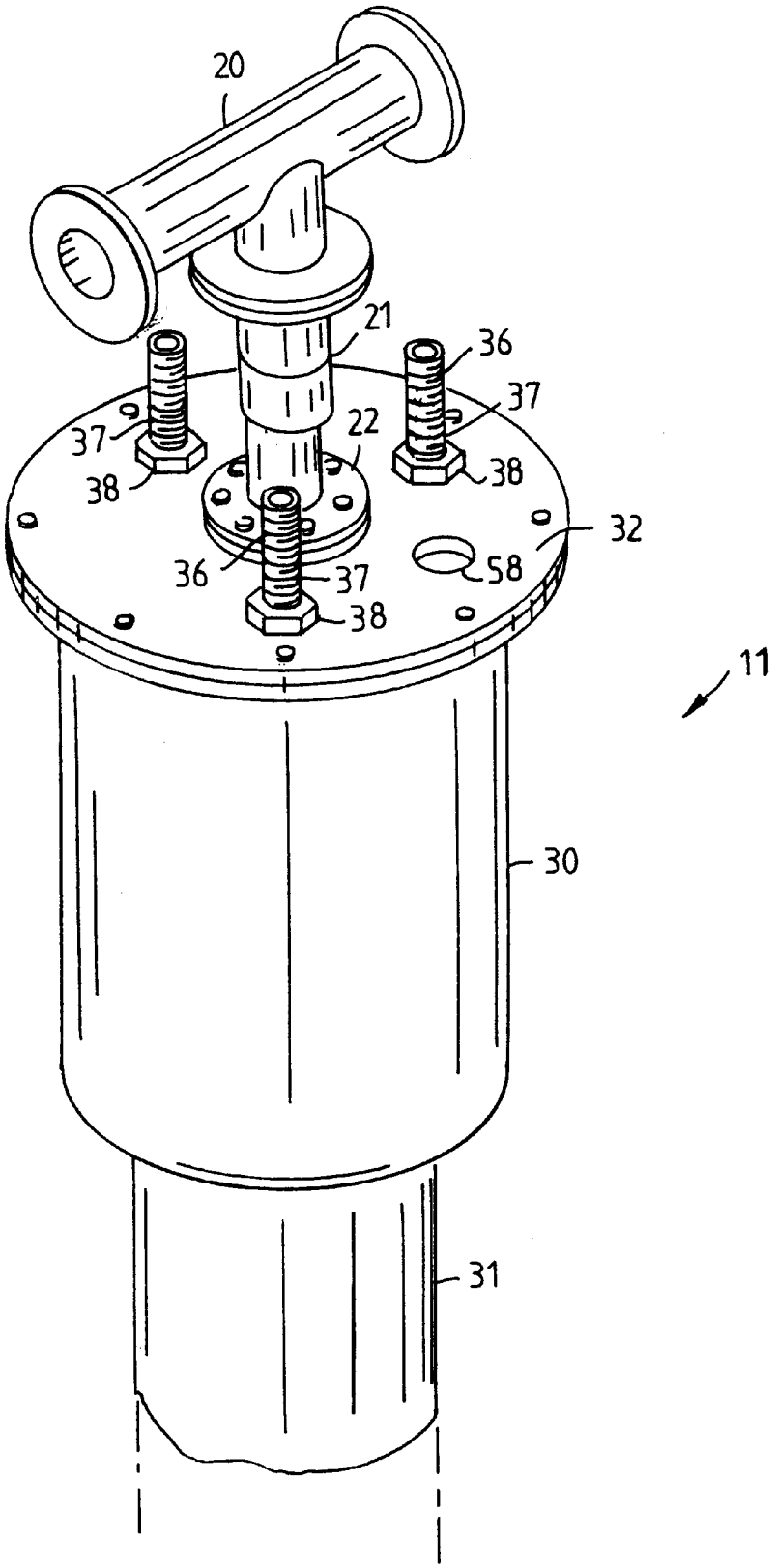
FIG. 2 is a perspective view of part of a flotation column used in the apparatus of FIG. 1.

Alternatively or additionally, one or more openings 58 (FIG. 2) may be provided in the cover plate 32 to allow for entrainment of air by the jet of slurry.

Through being directed in the receptacle 34 in the path of the jet 50 is obstructed and the jet and air entrained with it are forced together in the limited volume of the receptacle. Extremely high turbulence results as the slurry and the air stream entrained with it stopped and forced to reverse direction inside the receptacle 34. The consequent high shear forces which are produced in this process will lead to the formation of a foam or froth 51 of fine bubbles within the receptacle 34 (FIG. 4). Due to the influx of slurry and air into the receptacle 34, the foam or froth 51 formed within the receptacle is forced out of the upper open end of the receptacle as indicated by numerals 52, filling the downcomer 11 with foam or froth 53.

Thus a hydrostatic head of foam or froth is formed in the downpipe 11 which will cause the foam or froth to issue from the open bottom 12 of the downpipe 11 and to rise up through the liquid in the separating vessel 13 to form a foam or froth liquid interface 54 and a layer of foam or froth 55 above the interface 54. As the foam or froth level builds up above the interface 54 it will spill over the edge of the separating vessel 13 into the launder 14 from where it is removed through the outlet 15.

Experimental data on the effect of the receptacle 34 was obtained using a system with a downcomer of 1500 mm length, using a single nozzle of 7 mm ID. A commercial frother was added to the liquid (ordinary tap water) in a concentration of 50 ppm in order to prevent coalesence.

Bubble diameters and gas consumption rate were measured for identical conditions, but with and without the receptacle 34.

Experimental Results

The results are indicated in the following diagram and table in which the receptacle 34 is referred to as JBD (jet breakup device).

Diagram 1

The probability density function indicates a higher probability for the production of a finer average bubble size when the jet breakup device is used.

Table 1

The gas consumption rate could be increased by 40% under the experimental conditions, when the JBD was introduced.

The surface-average (or Sauter) mean diameter, dA, an important parameter to describe size distributions in surface-related processes with a single parameter, could be reduced by 24% when using the jet breakup device.

The surface production rate, which is here defined as the rate at which bubble surface is produced by the system, in $m^2$ per $m^2$ of downpipe volume and per second, was found to be increased by 85%. This parameter indicates how much bubble surface area per second a piece of equipment makes available for a (surface-related) process. It is a parameter influenced by bubble size and gas consumption rate. The finer the bubbles, and the higher the gas rate, the higher the surface production rate will be.

FIG. 1: pdf with and without JBD. Jet length = 200 mm, nozzle diameter = 7 mm, jet velocity = 6.4 m/s, JBD ID = 25 mm, JBD height = 50 mm, Frother 50 ppm Betafroth.

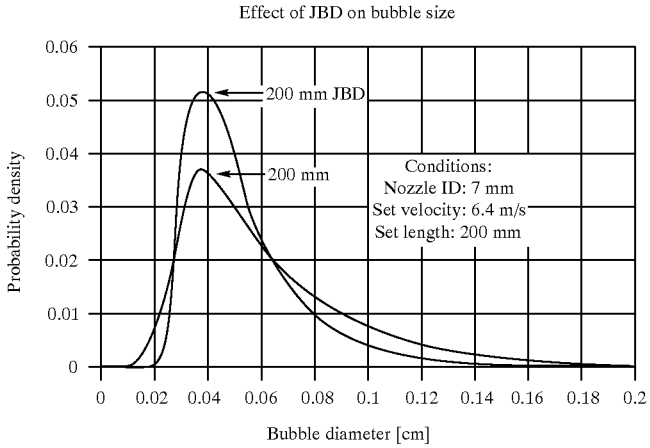

TABLE 1

Characteristic data for system with and without JBD; Gas consumption ($Q_G$ m3/s), Surface-average diameter($d_\lambda$ mm), surface production rate [$m^2m^3s$]

| | without JBD | with JBD | % change |
|---|---|---|---|
| $Q_z$ | 2.13E−04 | 2.98E−04 | +40 |
| $d_\lambda$ | 1.55 | 1.17 | −24 |
| $6Q_G/Vd_\lambda$ | 143 | 265 | +85 |

The dimensions of the receptable 34 may be determined by the following considerations. The maximum diameter will be such that the foam or froth produced within the device, which issues from the top of the receptacle 34, can flow freely through the annulus between the receptacle and the downpipe. The minimum diameter will be equal to the diameter of the jet at that particular disease. In all practical applications the diameter will be between those two limits. The length of the receptacle 34 will be chosen from considerations such as wear on the receptacle and sizes of the bubbles produced. Typically, a length of ten jet diameters will be appropriate. Nevertheless, according to the desired purpose, any suitable length may be chosen.

In other forms, the apparatus may include more than one jet issuing into one receptacle, or a number of jets in parallel issuing into a plurality of receptacles. This might be desirable if the air entrainment rate is to be maximized, as that rate will increase with the jet surface area. It is also considered that the path of the jet or jets may be other than vertical.

In use of the flotation apparatus, additional air or gas bubbles may be introduced at a low level in the separating vessel 13 through a suitable sparger (not shown) to assist in flotation of particles in the liquid contained in the vessel 13. A tailings outlet 56 is provided in the separating vessel 13.

Thus the invention provides a method and apparatus for aeration of liquids which is believed will have advantages over prior art systems.

Many other embodiments of the invention may be made differing in detail from that described above and without departing from the scope of the invention as defined in the appended claims.

What is claimed is:

1. A method of aerating a liquid comprising the steps of:

providing a column having a receptacle located within an upper zone of the column and having an open lower end;

locating the lower end of the column in a vessel;

introducing liquid under pressure into the upper zone of the column in the form of a jet of liquid;

permitting gas to be entrained by the jet of liquid through an opening leading into the column;

directing the jet of liquid into the receptacle so that the receptacle obstructs the path of the jet of liquid to form a zone of turbulence in which bubbles are formed in the liquid to create foam or froth sufficient to overflow from the receptacle into the column, thereby forming a foam or froth bed in the column;

permitting the foam or froth to issue from the open lower end of the column and to rise upwardly in the liquid in the vessel to form a foam or froth liquid interface and to form a foam or froth layer above the interface; and removing the foam or froth.

2. A method as claimed in claim 1, further comprising varying the amount of foam or froth formed in the receptacle by adjusting the height of the receptacle within the column.

3. A method of aerating a liquid comprising the steps of:

providing a column having an obstacle therein which is located within an upper zone of the column and having an open lower end;

locating the lower end of the column in a vessel;

introducing liquid under pressure into the upper zone of the column in the form of a jet of liquid;

permitting gas to be entrained by the jet of liquid through an opening leading in the column;

directing the jet of liquid against the obstacle so as to obstruct the path of the jet of liquid to form a zone of turbulence in which bubbles are formed in the liquid to create foam or froth sufficient to overflow from the obstacle into the column, thereby forming a foam or froth bed in the column;

permitting the foam or froth to issue from the open lower end of the column and to rise upwardly in the liquid in the vessel to form a foam or froth liquid interface and to form a foam or froth layer above the interface.

4. Apparatus for aerating a liquid comprising:

a vessel containing liquid;

a column having an upper zone and having an open lower end;

a nozzle provided in the upper zone of the column for permitting a jet of liquid to be directed under pressure in a path into the upper zone;

a gas inlet for permitting entrainment of gas by the jet of liquid;

a receptacle mounted in the upper zone of the column in a position to define an obstruction for obstructing the path of the jet of liquid for thereby forming a zone of turbulence in which bubbles are formed in the liquid to create foam or froth overflowing from the receptacle into the column, thereby to form a foam or froth bed in the column;

the column being mounted with the lower end thereof in the vessel so that foam or froth formed in the receptacle issues from the lower end of the column and rises upwardly in the vessel to form a foam or froth liquid interface and a foam or froth layer above the interface; and means for removing the foam or froth.

5. Apparatus as claimed in claim 4, in which the receptacle is mounted coaxially in the upper zone.

6. Apparatus as claimed in claim 4, further comprising a cover closing the upper end of the column and gas inlet comprises an opening in the cover.

7. Apparatus as claimed in claim 4, further comprising a cover closing the upper end of the column; elongate members depending from the cover; and the receptacle is suspended from the elongate members.

8. Apparatus as claimed in claim 7, in which the elongate members are extensible and retractable relative to the cover to adjust the height of the receptacle in the column.

9. Apparatus as claimed in claim 8, in which the elongate members are open-minded tubular members providing the gas inlet permitting entrainment of gas by the jet of liquid.

10. Apparatus as claimed in claim 7, in which the elongate members are open-minded tubular members providing the gas inlet permitting entrainment of gas by the jet of liquid.

11. Apparatus for aerating a liquid comprising:

a vessel containing liquid;

a column having an upper zone and having an open lower end;

a nozzle provided in the upper zone of the column for permitting a jet of liquid to be directed under pressure in a path into the upper zone;

a gas inlet for permitting entrainment of gas by the jet of liquid;

an obstruction located in the upper zone of the column in a position for obstructing the path of the jet of liquid for thereby forming a zone of turbulence in which bubbles are formed in the liquid to create foam or froth overflowing from the obstacle and into the column, thereby to form a foam or froth bed in the column;

the column being mounted with the lower end thereof in the vessel so that foam or froth formed at the obstruction issues from the lower end of the column and rises upwardly in the vessel to form a foam or froth liquid interface and a foam or froth layer above the interface.

* * * * *

UNITED STATES PATENT AND TRADEMARK OFFICE

CERTIFICATE OF CORRECTION

PATENT NO : 6,092,667

DATED : July 25, 2000

INVENTOR(S) : Arno Steinmuller et al.

It is certified that error appears in the above identified patent and that said Letters Patent are hereby corrected as shown below.

[73] Assignee: Multotec Process Equipment (Pty) Limited,
South Africa

Signed and Sealed this

Eighth Day of May, 2001

*Attest:*

Nicholas P. Godici

NICHOLAS P. GODICI

*Attesting Officer*

*Acting Director of the United States Patent and Trademark Office*